US010024143B2

(12) United States Patent
Molina

(10) Patent No.: US 10,024,143 B2
(45) Date of Patent: Jul. 17, 2018

(54) JUMPER TUBE CONNECTION FOR WELLSCREEN ASSEMBLY

(71) Applicant: David Molina, Houston, TX (US)

(72) Inventor: David Molina, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 358 days.

(21) Appl. No.: 14/736,910

(22) Filed: Jun. 11, 2015

(65) Prior Publication Data

US 2016/0362966 A1 Dec. 15, 2016

(51) Int. Cl.
*E21B 43/04* (2006.01)

(52) U.S. Cl.
CPC ..... *E21B 43/04* (2013.01)

(58) Field of Classification Search
CPC ..... E21B 17/042; E21B 17/046; E21B 17/02; E21B 17/18; E21B 17/07; E21B 17/0423; E21B 19/16
See application file for complete search history.

(56) References Cited

U.S. PATENT DOCUMENTS

| | | | |
|---|---|---|---|
| 4,945,991 | A | 8/1990 | Jones |
| 5,113,935 | A | 5/1992 | Jones et al. |
| 5,341,880 | A | 8/1994 | Thorstensen et al. |
| 5,390,966 | A | 2/1995 | Cox et al. |
| 5,415,441 | A | 5/1995 | Kilgore et al. |
| 5,515,915 | A | 5/1996 | Jones et al. |
| 5,868,200 | A | 2/1999 | Bryant et al. |
| 6,227,303 | B1 | 5/2001 | Jones |
| 6,405,800 | B1 | 6/2002 | Walker et al. |
| 6,409,219 | B1 | 6/2002 | Broome et al. |
| 7,497,267 | B2 | 3/2009 | Setterberg, Jr. et al. |
| 7,828,056 | B2 | 11/2010 | Dybevik et al. |
| 7,971,642 | B2 | 7/2011 | Yeh et al. |
| 2002/0189809 | A1 | 12/2002 | Nguyen et al. |
| 2010/0059232 | A1 | 3/2010 | Langlais et al. |
| 2010/0155064 | A1 | 6/2010 | Nutley et al. |
| 2010/0236779 | A1 | 9/2010 | Nutley et al. |
| 2014/0158373 | A1 | 6/2014 | Least et al. |

(Continued)

OTHER PUBLICATIONS

Halliburton, "PetroGuard(R) Shunt System," Brochure H010929, copyright 2014, dated Mar. 2014.

(Continued)

*Primary Examiner* — Wei Wang
(74) *Attorney, Agent, or Firm* — Blank Rome LLP

(57) ABSTRACT

A wellscreen assembly has first and second screen joints connected together and has at least first and second adjoining tubes with opposed ends separated by a gap from one another. At least one jumper tube has first and second tubulars and fits in the gap between the adjoining tubes. The first tubular has a first end connectable to one of the opposed ends, while the second tubular has a second end connectable to another of the opposed ends. The second tubular is telescopically connected to the first tubular, and a biasing element biases the first and second tubulars away from one another. The first and second tubulars are operable between (i) a retracted condition retracting the first and second ends from the opposed ends and (ii) an extended condition extending the first and second ends to the opposed ends of the adjoining tubes.

25 Claims, 8 Drawing Sheets

(56) References Cited

U.S. PATENT DOCUMENTS

| | | | | |
|---|---|---|---|---|
| 2014/0262332 | A1 | 9/2014 | McNamee et al. | |
| 2015/0233216 | A1* | 8/2015 | Rodrigue | E21B 43/08 166/380 |

OTHER PUBLICATIONS

Weatherford, "Openhole Shunted Screen System," Multi-Function Screens brochure 8348.01, copyright 2011, obtained from http://www.weatherford.com/dn/WFT156088 on Jan. 22, 2015.

Weatherford, "Shunt-Tube Technology," presentation, copyright 2011, obtained from http://www.weatherford.com/dn/WFT174871 on Jan. 22, 2015.

* cited by examiner

JUMPER TUBE CONNECTION FOR WELLSCREEN ASSEMBLY

BACKGROUND OF THE DISCLOSURE

Production of hydrocarbons from loose, unconsolidated, and/or fractured formations often produces large volumes of particulates along with the formation fluids. These particulates can cause a variety of problems. For this reason, operators use gravel packing as a common technique for controlling the production of such particulates.

To gravel pack a completion, a screen is lowered on a workstring into the wellbore and is placed adjacent the subterranean formation. Particulate material, collectively referred to as "gravel," and a carrier fluid are pumped as a slurry down the workstring. Eventually, the slurry can exit through a "cross-over" into the wellbore annulus formed between the screen and the wellbore.

The carrier liquid in the slurry normally flows into the formation and/or through the screen itself. However, the screen is sized to prevent the gravel from flowing through the screen. This results in the gravel being deposited or "screened out" in the annulus between the screen and the wellbore to form a gravel-pack around the screen. The gravel, in turn, is sized so that it forms a permeable mass that allows produced fluids to flow through the mass and into the screen but blocks the flow of particulates into the screen.

Due to poor distribution, it is often difficult to completely pack the entire length of the wellbore annulus around the screen so that an interval in the annulus is not completely gravel packed. This poor distribution of gravel is often caused by the carrier liquid in the slurry being lost to the more permeable portions of the formation. Due to the loss of the carrier liquid, the gravel in the slurry forms "sand bridges" in the annulus before all of the gravel has been placed around the screen. Such bridges block further flow of the slurry through the annulus, thereby preventing the placement of sufficient gravel below the bridge in top-to-bottom packing operations or above the bridge in bottom-to-top packing operations.

Alternate flow conduits, called shunt tubes, can alleviate this bridging problem by providing a flow path for the slurry around such sand bridges. The shunt tubes are typically run along the length of the wellscreen and are attached to the screen by welds. Once the screen assemblies are joined, fluid continuity between the shunt tubes on adjacent screen assemblies must be provided, and several techniques have been developed to provide such continuity.

FIGS. 1A-1B are schematic views of examples of sand screens 18*a-b* provided with shunt tubes 30*a-b* in a wellscreen assembly 10. FIG. 2A illustrates an exploded view of the components for the wellscreen assembly 10 for use in an open hole. As an alternative, FIG. 2B illustrates an exploded view of components for the wellscreen assembly 10 for use in a cased hole.

In the assembly 10, a first sand control device 12*a* is coupled to a second sand control device 12*b*, and each device 12*a-b* has basepipe joints 14 joined together to define a production bore 16. Screens 18*a-b* having filter media surround the basepipe joints 14 and are supported by ribs 19. The assembly 10 is provided with shunt tubes 30*a-b*, which in this example are steel tubes having substantially rectangular cross-section. The shunt tubes 30*a-b* are supported on the exterior of the screens 18*a-b* and provide an alternate flow path 32 to the main production bore 16.

To provide fluid communication between the adjacent sand control devices 12*a-b*, jumper tubes 40 are disposed between the shunt tubes 30*a-b*. In this way, the shunt tubes 30*a-b* and the jumper tubes 40 maintain the flow path 32 outside the length of the assembly 10, even if the borehole's annular space B is bridged, for example, by a loss of integrity in a part of the formation F.

Additional examples of shunt tube arrangements can be found in U.S. Pat. No. 4,945,991 and U.S. Pat. No. 5,113,935. The shunt tubes may also be internal to the filter media, as described in U.S. Pat. No. 5,515,915 and U.S. Pat. No. 6,227,303.

As shown in FIGS. 1A-1B and 2A, the assembly for an open hole completion typically has main shrouds 28*a-b* that extend completely over the sand control devices 12*a-b* and provides a protective sleeve for the filter media and shunt tubes 30*a-b*. The shrouds 28*a-b* have apertures to allow for fluid flow. The main shrouds 28*a-b* terminate at the end rings 20*a-b*, which supports ends of the shroud 28*a-b* and have passages for the ends of the shunt tubes 30*a-b*. For a cased-hole completion, the assembly 10 as shown in FIG. 2B may lack a shroud.

Either way, the shunt tubes 30*a-b* stop a certain length from the ends of the sand control devices 12*a-b* to allow handling room when the devices 12*a-b* are joined together at the rig. Once the devices 12*a-b* are joined, their respective shunt tubes 30*a-b* are linearly aligned, but there is a gap between them. Continuity of the shunt tubes' flow path 32 is typically established by installing the short, pre-sized jumper tubes 40 in the gap.

Each jumper tube 40 has a connector 50 at each end that contains a set of seals and is designed to slide onto the end of the jumper tube 40 in a telescoping engagement. When the jumper tube 40 is installed into the gap between the shunt tubes 30*a-b*, the connector 50 is driven partially off the end of the jumper tube 40 and onto the end of the shunt tube 30*a-b* until the connector 50 is in a sealing engagement with both shunt tubes 30*a-b* and the jumper tube 40. The shunt tubes' flow path 32 is established once both connectors 50 are in place. A series of set screws (not shown) can engage both the jumper tube 40 and adjoining shunt tube 30*a-b*. The screws are driven against the tube surfaces, providing a friction lock to secure the connector 50 in place. Because the shunt tube assembly needs to be set with set screws, more than one person may be required to install the assembly, and different tools may be needed to fix the set screws into position. In some arrangements, a total of eight set screws may need to be individually fixed per tube, therefore taking more time to run a screen downhole. For some installations, all of this installation work results in a rate of running approximately five (5) screens per hour at the rig.

Moreover, this connection may not be very secure, and there is concern that debris or protruding surfaces of the wellbore can dislodge the connectors 50 from sealing engagement with the tubes 30*a-b* and 40 while running the wellscreen assembly 10 into the wellbore. Therefore, a shroud, such as a device called a split cover 22 as shown in FIG. 1A, is typically used to protect the connectors 50. The split cover 22 is a piece of thin-gauge perforated tube, essentially the same diameter as the screen assembly 10, and the same length as the gap covered by the jumper tubes 40. The perforated cover 22 is spit into halves with longitudinal cuts, and the halves are rejoined with hinges along one seam and locking nut and bolt arrangements along the other seam. The split cover 22 can be opened, wrapped around the gap area between the sand control devices 12*a-b*, and then closed and secured with the locking bolts.

Other ways of connecting shunt tubes on adjoining sand control devices are known in the art. For example, U.S. Pat.

No. 6,409,219 to Broome et al. describes a system wherein shunts on adjacent sand control devices are aligned when the correct torque is applied to join the devices. Alignment marks are included on the devices to indicate when the correct torque has been applied.

U.S. Pat. No. 5,341,880 to Thorstensen et al. describes a sand screen structure assembled from a plurality of generally tubular filter sections that are axially snapped together in a manner facilitating the simultaneous interconnection of circumferentially spaced series of axially extending shunt tubes secured to and passing internally through each of the filter sections. In an alternate embodiment of the sand screen structure, the shunt tubes are secured within external side surface recesses of the filter section bodies.

U.S. Pat. No. 5,868,200 to Bryant et al. describes an alternate-path wellscreen that is made-up of joints. The screen has a sleeve positioned between the ends of adjacent joints. The sleeve acts as a manifold for fluidly-connecting the alternate-paths on one joint with the alternate-paths on an adjacent joint.

Another connector is disclosed in U.S. Pat. No. 7,497,267, which is incorporated herein by reference. FIGS. 3A-3B show examples of connections 100*a-b* disclosed therein. The connections 100*a-b* secure a jumper tube 40 to shunt tubes 30. In general, the connections 100*a-b* are designed to slide onto the end of the jumper tube 40 in a telescoping engagement. When the jumper tube 40 is installed into the gap between the shunt tubes 30, the connections 100*a-b* are driven partially off of the end of the jumper tube 40 and onto the end of the shunt tube 30 to form a sealing engagement between both tubes 30 and 40. Lugs and set screws are then used to secure the connectors 100*a-b* in place.

For example, FIG. 3A shows a connection 100*a* having a connector 108 and a connector lock 102 disposed on a jumper tube 40. The jumper tube 40 has lugs 104 affixed to its sides. The connector 108 is pushed forward to engage a shunt tube 30 secured to the end ring 20. The connector lock 102 is the secured in place by screwing the screws 106 in the lock 102 to keep the lugs 104 in the side slots in the lock 102. The lugs 104 and screws 106 secure the lock 102 in the position to hold the connector 108 in the engaged position. As also shown in FIG. 3A, the connector 108 can include a sealing ring 109 to contact the shunt tube 30.

In another example, FIG. 3B shows a connection 100*b* having a connector 110 disposed on a jumper tube 40. A "C"-shaped receiver 112 is affixed to the shunt tube 30 and is positioned with the open side of the "C" toward the end of the tube 30. The connector 110 is moved to engage the shunt tube 30 so that the end of the connector 110 fits in the receiver 112. The connector 110 is attached to the jumper tube 40 with set screws 116, and other set screws 114 on the receiver 112 align with mating holes (not apparent in this view) in connector 110 to affix the tubes 30 and 40 together.

Yet another connector is disclosed in US Pub. 2014/0158373, which discloses a jumper tube that extends between and is sealably coupled to the transport tubes of opposing joints. First tubular members of the jumper tube have locking assemblies in the form of collet assemblies with collet fingers or locking housings with locking rings disposed on their ends. These first tubular members can extend telescopically from ends of a second tubular member for the jumper tube. With the tubular members extended, the collet fingers or locking rings on the ends of these members can engage locking grooves on the transport tubes to prevent the jumper tube form being able to disengage, thus negating the need for set screws.

Although the above-techniques for connecting shunt tubes on adjoining joints of a wellscreen assembly may be effective, operators seek more efficient and reliable ways to make these connections at the rig during deployment of the assembly. The subject matter of the present disclosure is directed to overcoming, or at least reducing the effects of, one or more of the problems set forth above.

SUMMARY OF THE DISCLOSURE

A jumper tube assembly is used for communicating opposed ends of adjoining tubes on connected wellscreen joints. The assembly includes first and second tubulars. The first tubular has a first end connectable to one of the opposed ends of the adjoining tubes, while the second tubular has a second end connectable to another of the opposed ends of the adjoining tubes. The second tubular is telescopically connected to the first tubular, and the first and second tubulars are operable between (i) a retracted condition retracting the first and second ends from the opposed ends of the adjoining tubes and (ii) an extended condition extending the first and second ends to the opposed ends of the adjoining tubes. A biasing element biases the first and second tubulars away from one another to the extended condition.

The first end of the first tubular can have a first connector connectable to the one opposed end, while the second end of the second tubular can have a second connector connectable to the other opposed end of the adjoining tubes. Each of the first and second connectors can have seals engaging the opposed ends of the adjoining tubes when connected thereto.

To telescopically connect the first and second tubulars, a third end of the first tubular can be disposed inside a fourth end of the second tubular. The third end can have the biasing element disposed thereon with the biasing element engaging an external shoulder on the third end and engaging an internal shoulder in the fourth end. At least one seal can seal between the third and fourth ends.

To communicate the opposed ends of the adjoining tubes on the connected wellscreen joints, the first and second tubulars of the jumper tube can then be retracted telescopically together against the bias. At this point, the retracted jumper tube can be positioned in a gap between the opposed ends of the adjoining tubes. The first and second tubulars can then be extended to an extended condition with the bias, and first and second ends of the extended first and second tubulars can engage on the opposed ends of the adjoining tubes.

The first and second ends of the extended tubulars can connect with first and second connectors to the opposed ends of the adjoining tubes and can seal therewith. To retract against the bias and to extend with the bias, a biasing element can engage on an external shoulder of one end of the first tubular disposed in another end of the second tubular. The biasing element can also engage on an internal shoulder of the other end of the second tubular. Sealing can be provided between the ends of the first and second tubulars.

During installation, the jumper tube assembly may be compressed by pushing the first tubular partially inside the second tubular against the bias of the biasing element or spring. This allows the connectors on each extreme end of the tubular to fit between the opposed ends of the adjoining shunt tubes. Once released, the biasing element within the assembly allows the two tubulars to extend so that the connectors position into place on the opposed ends of the adjoining tubes. In one embodiment, the bias from the biasing element may be sufficient to hold the tubulars in place on the shunt tubes so that additional fasteners or other forms of fixing may not be necessary, although they could be. Moreover, the assembly can include a shroud or split cover for protecting the jumper tube assembly.

The jumper tube assembly may not require set screws so the assembly can meet the need for running more screens per hour. Using existing assemblies, about five wellscreens can be run per hour in some cases, but it is desired to run more wellscreens (e.g., approximately 10) per hour. Without the need to fix multiple set screws, the disclosed jumper tube assembly can shorten the time needed to connect the adjoining shunt tubes on the connected screens, increasing the rate at which the wellscreens can be run downhole.

The foregoing summary is not intended to summarize each potential embodiment or every aspect of the present disclosure.

DETAILED DESCRIPTION OF THE DISCLOSURE

Embodiments of a wellscreen assembly according to the present disclosure include basepipe joints and screen sections attached to the outer surface of the basepipe joints. The assembly also features shunt tubes attached to the basepipe joints via top and bottom end rings. The shunt tubes can be attached to the screen sections via B-rings and may be transport tubes or packing tubes for gravel packing operations or the like. Embodiments of the present disclosure provide connections for securing a jumper tube to adjoining shunt tubes of adjoining joints of the wellscreen assembly, which may be used in open or cased holes.

The wellscreen assembly of the present disclosure can be used in open-hole or cased-hole applications. Cased-hole wellscreen assemblies may typically use centralizers disposed between wellscreen joints and may not have end rings at the various joints. As will be appreciated, the joints of the wellscreens assemblies have timed threads so that the various shunt tubes can be aligned with one another along the assembly as the joints are made up. Although these and other features of a wellscreen assembly may not be shown in the following figures, their use, purpose, and inclusion would be understood by a person of ordinary skill in the art having the benefit of the present disclosure.

Figure 1A:
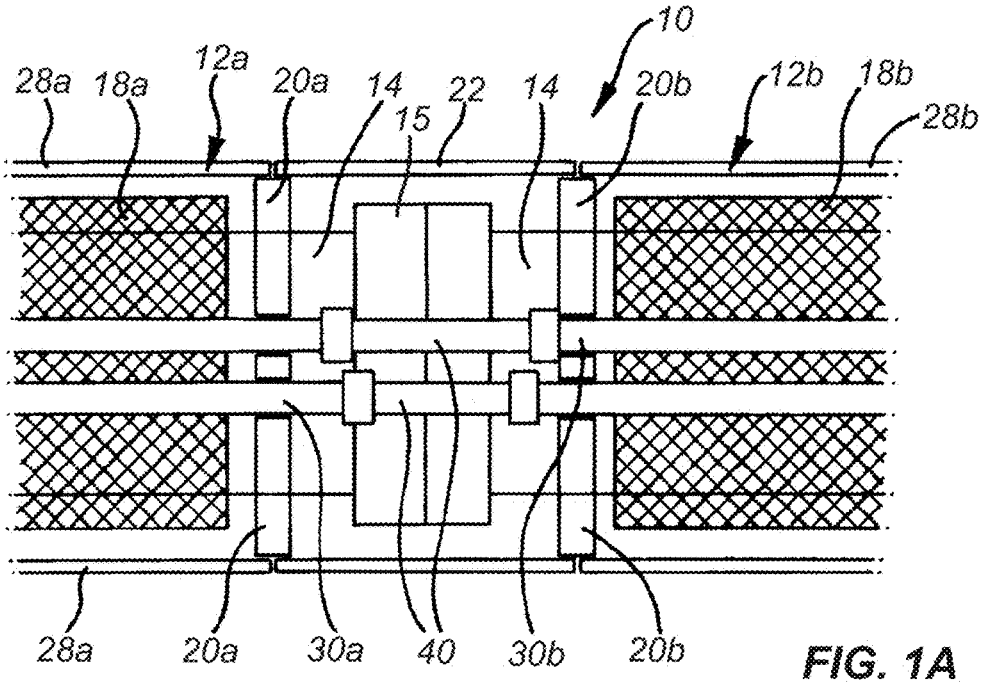
FIG. 1A (Prior Art)
FIG. 1A illustrates a side view of an open hole wellscreen assembly according to the prior art for an open hole.
Figure 1B:
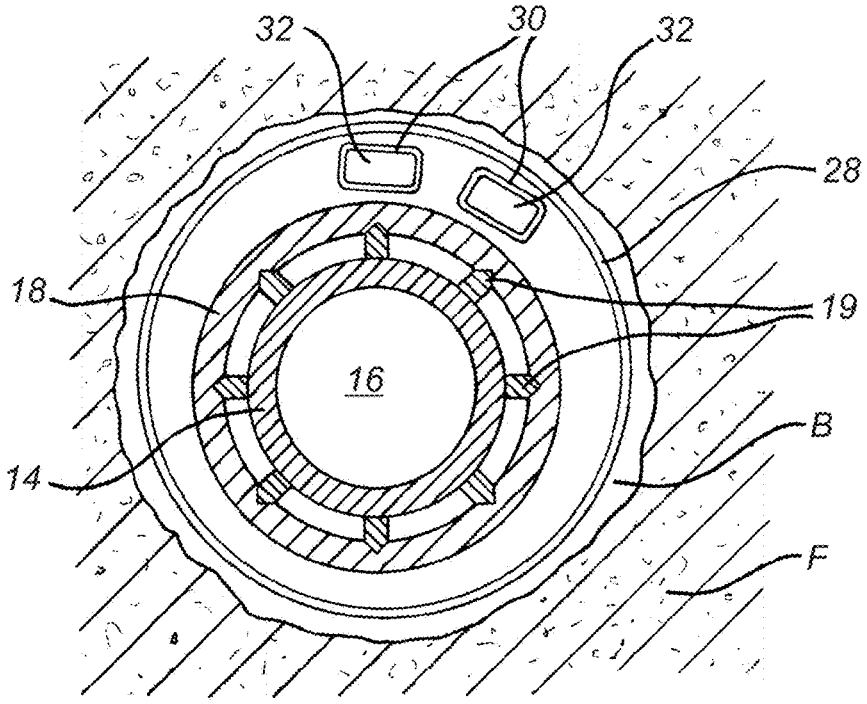
FIG. 1B (Prior Art)
FIG. 1B illustrates an end view of the open-hole wellscreen assembly of FIG. 1A.
Figure 2A:
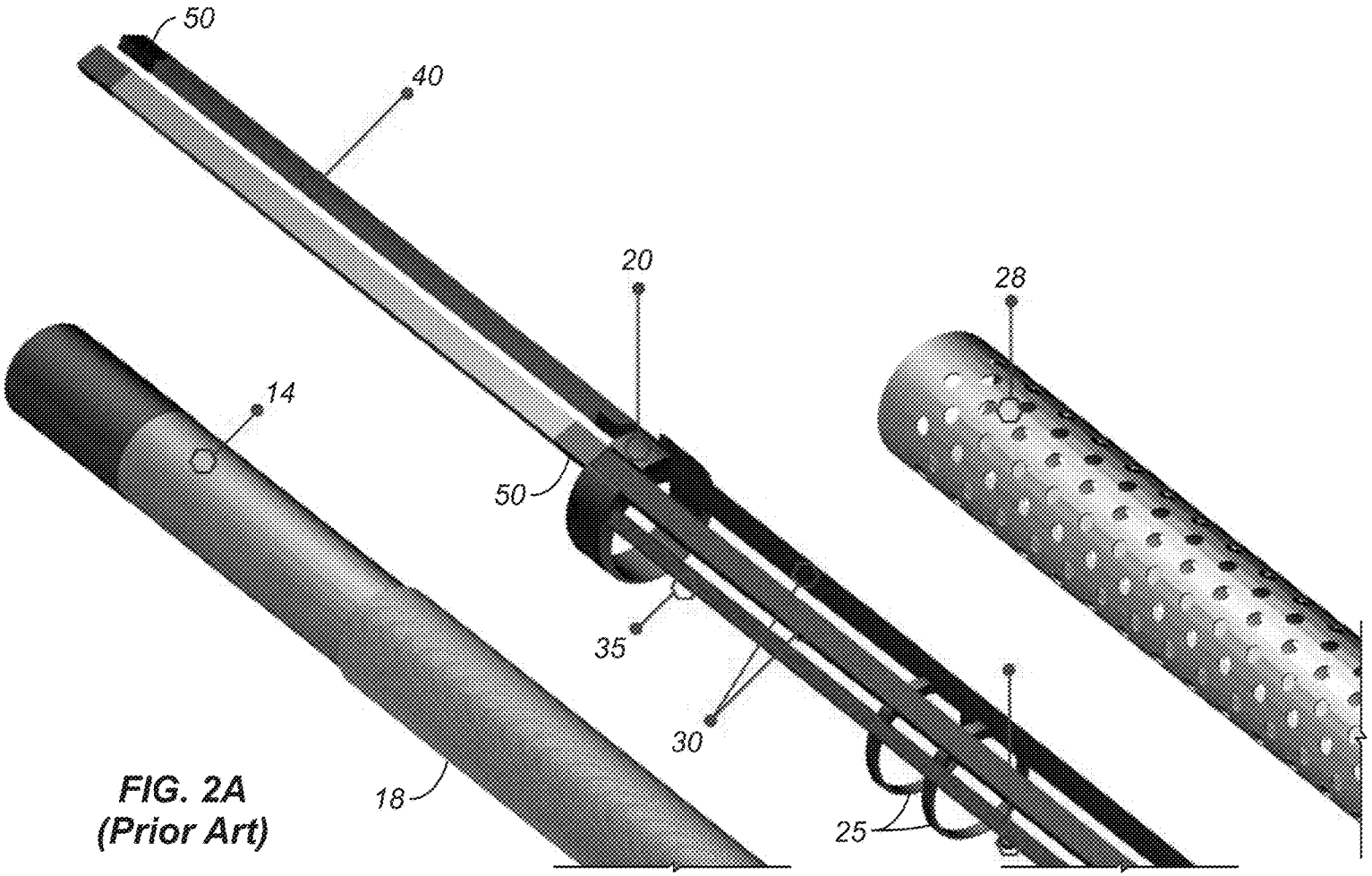
FIG. 2A (Prior Art)
FIG. 2A illustrates an exploded view of the components for the open-hole wellscreen assembly of FIG. 1A.
Figure 2B:
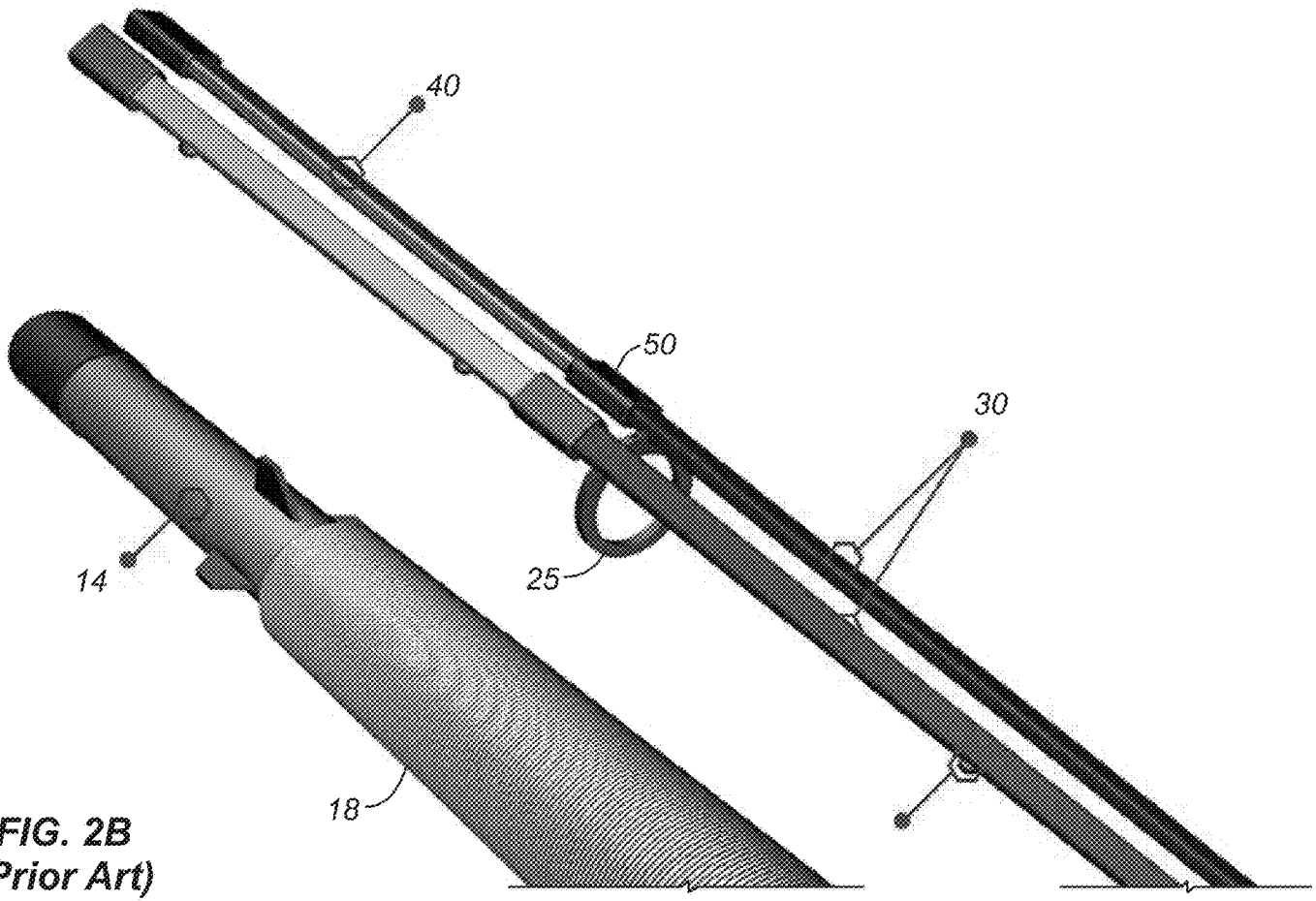
FIG. 2B (Prior Art)
FIG. 2B illustrates an exploded view of components for a cased-hole wellscreen assembly.
Figure 3A:
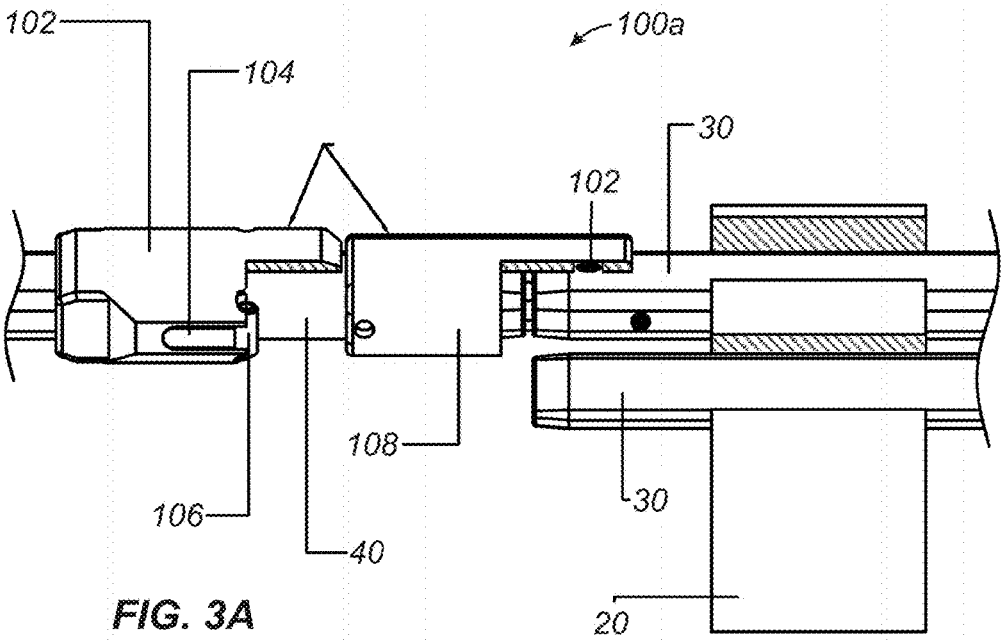
FIG. 3A (Prior Art)
FIG. 3A illustrates a side view of a prior art connector for shunt tubes of a wellscreen assembly.
Figure 3B:
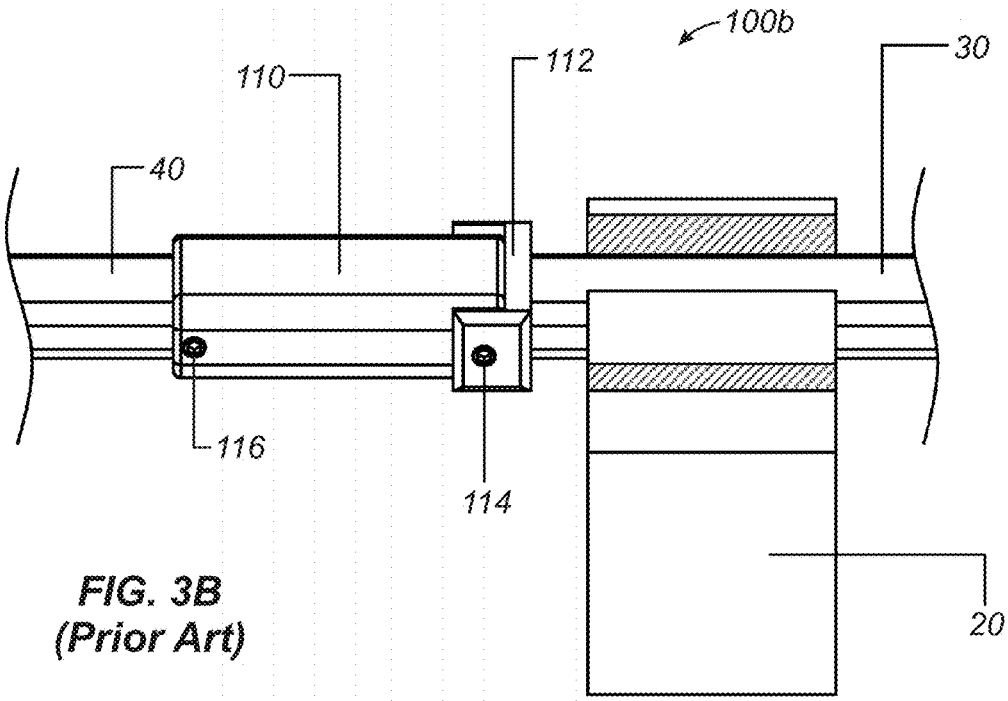
FIG. 3B (Prior Art)
FIG. 3B-3C illustrate side and perspective views of another prior art connector for shunt tubes of a wellscreen assembly.
Figure 3C:
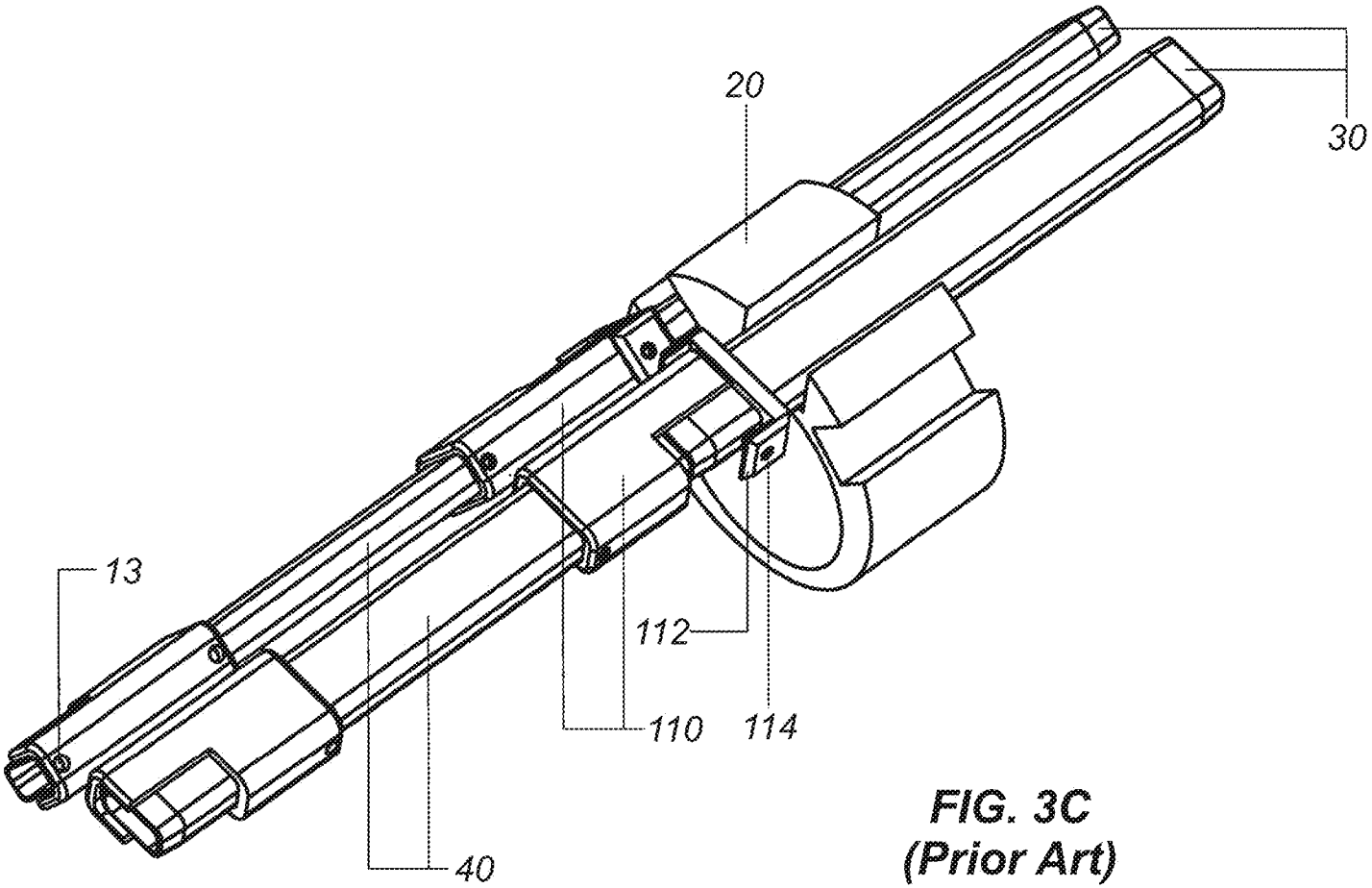
FIG. 3C (Prior Art)
Figure 4:
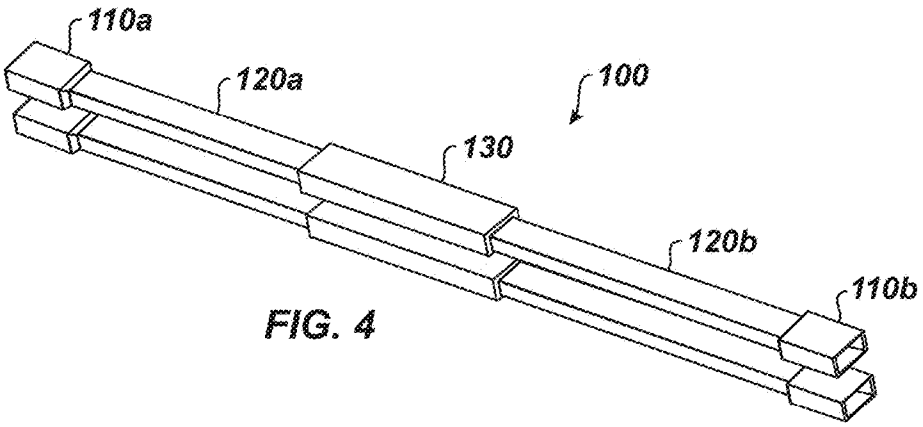
FIG. 4 illustrates a telescopic jumper tube assembly according to the present disclosure for a wellscreen assembly.

Turning to FIG. 4, a telescopic jumper tube assembly 100 of the present disclosure is shown in a perspective view. As discussed herein, the jumper tube assembly 100 can be used for wellscreen assemblies having joints coupled together with opposed ends of adjoining shunt tubes separated by a gap.

The jumper tube assembly 100 includes end connector ends 110*a-b* disposed on opposing tubulars (connector tubes) 120*a-b* that mate together at a telescopic housing 130. During assembly between opposing shunt tubes (not shown), the ends 110*a-b* can be brought together by telescoping the connector tubes 120*a-b* in the housing 130 so the jumper tube assembly 100 can fit in the gap between adjoining shunt tubes.

Figure 5A:
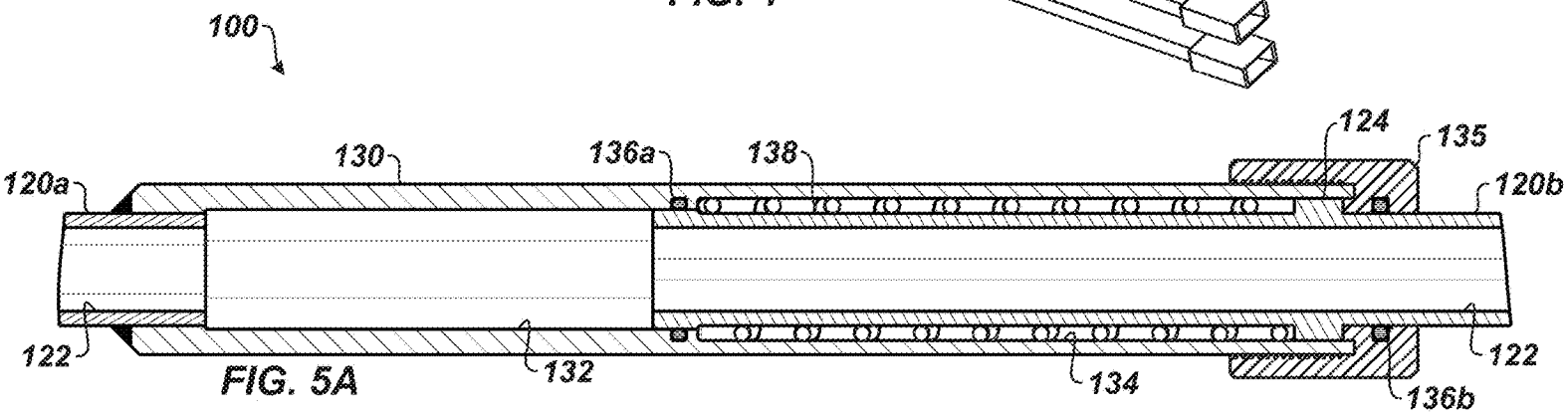
FIGS. 5A-5B illustrate details of the disclosed assembly during retraction and expansion.
Figure 5B:
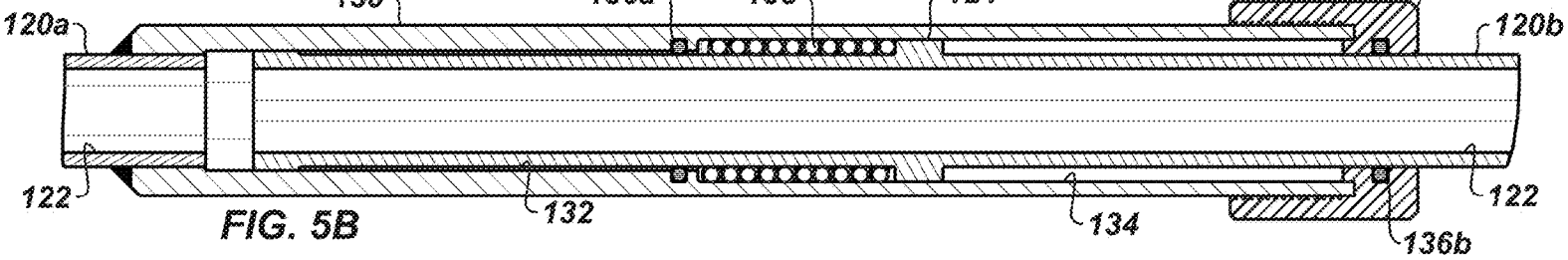

FIGS. 5A-5B illustrate details of the telescopic housing 130 between the connector tubes 120*a-b*. The housing 130 is connected to the connector tube 120*a* (by welding or the like) and has an interior 132 in communication with the tube's passageway 122. The opposing connector tube 120*b* is inserted in to the housing's interior 132 and has a passageway 122 for communication with the interior 132. A counterbore 134 of the interior 132 holds a biasing element, such as a spring 138, that biases against a shoulder 124 on the opposing connector tube 120*b*. (Although a spring 138 is shown as the biasing element providing bias, other elements known in the art can be used for bias, including a gas chamber, other types of springs, etc.)

A first seal 136*a* inside the housing's interior 132 seals against a free end of the opposing tube 120*b*. A second seal 136*b* at the other end of the interior 132 seals against an intermediate portion of the opposing tube 120*b*. Additional seals can be provided.

The assembly 100 is shown in the expanded state in FIG. 5A with the spring 138 pushing the opposing tubes 120*a-b* away from one another. In FIG. 5B, the assembly 100 is shown in the retracted state with the opposing tubes 120*a-b* pushed inward against the bias of the spring 138.

It will be appreciated that one or more of the components of the assembly 100 need to be modular to allow for assembly 100 of the components together. For example, the housing 130 may have first and second housing components that thread or connect together. This will allow the end of the one tube 120*b* to be positioned with the spring 138 thereon in one of the housing components. Then, the other housing component can slide down along the other tube 120*b* to connect and complete the housing 130 with the end of the tube 120*b* and spring 138 contained therein.

As specifically shown in FIGS. 5A-5B, for example, the housing 130 can have an end cap 135 that threads to an end of the housing 130 to facilitate assembly. In particular, the housing 130 can be affixed to the one connector tube 120*a* by welding or the like so that an open end of the housing 130 is exposed for insertion of other components. The spring 138 can be inserted onto the free end of the other connector tube 120*b*, and the tube's end with the spring 138 can then insert into the open end of the housing 130. At this point, the end cap 135 can slide along the other tube 120*b* to thread to the open end of the housing 130 to contain the spring 138 and tube 120*b* in the housing 130. As will be appreciated with the benefit of this disclosure, other modular forms of construction can be used to facilitate assembly.

Figure 6A:
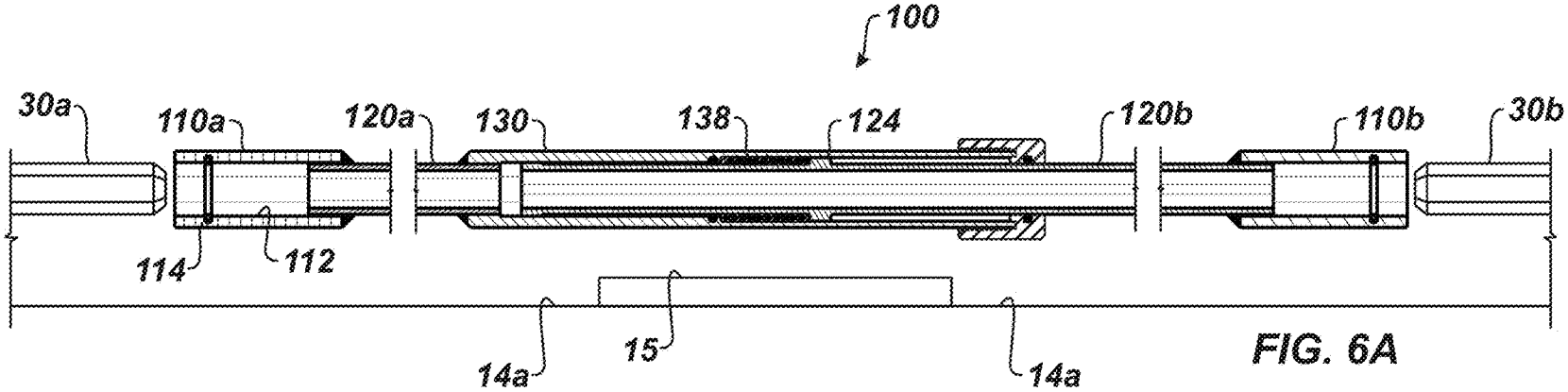
FIGS. 6A-6B illustrate the disclosed assembly during installation.
Figure 6B:
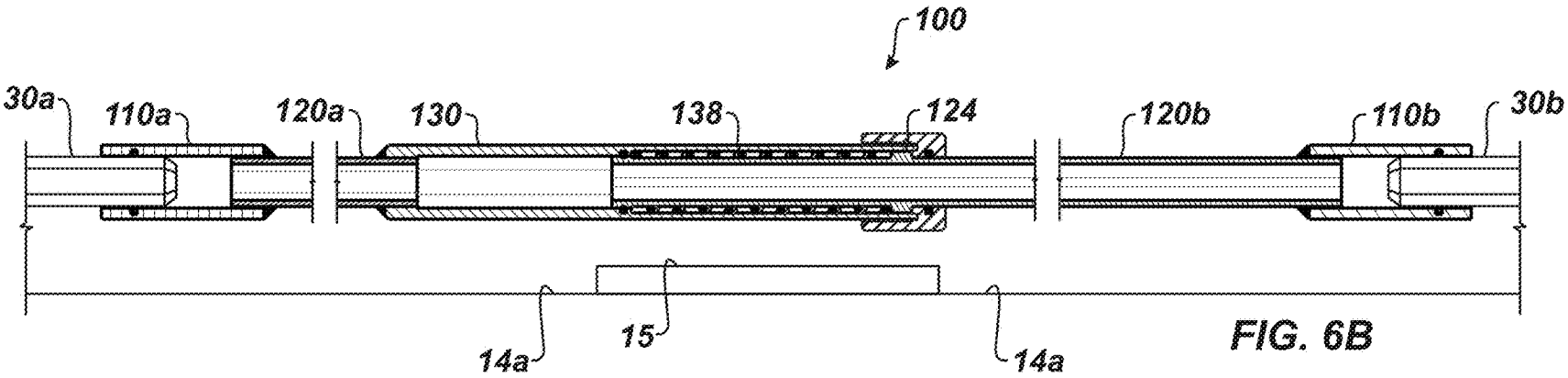

FIGS. 6A-6B illustrate the telescopic jumper tube assembly 100 being connected between shunt tubes 30*a-b* of adjoining wellscreen sections (not shown). When wellscreen joints 14*a-b* are made up with a joint connector 15 as schematically shown, the two ends of the in-line shunt tubes 30*a-b* disposed at the end rings (not shown) on the joints 14*a-b* are separated from one another. To complete the communication of the in-line shunt tubes 30*a-b*, operators compress the telescopic jumper tube assembly 100 to bring the two ends 110*a-b* together. The jumper tube assembly 100 is then positioned next to the joints 14*a-b* and positioned in-line with the opposing ends of the shunt tubes 30*a-b*.

At this point, operators allow the spring 138 to extend the end connectors 110*a-b* to fit onto the ends of the opposing shunt tubes 30*a-b*. As an alternative to fitting onto the shunt tubes 30*a-b*, the end connectors 110*a-b* can fit partially inside the shunt tubes 30*a-b* or can engage a portion of the end rings (not shown) to which the shunt tubes 30*a-b* connect. O-rings or other seals 114 inside the end connectors 110*a-b* can engage the ends of the shunt tubes 30*a-b* to seal the communication.

If desired, locking features can be used to affix the connectors 110*a-b* in place. For instance, locking features known in the art can be used. As an alternative, features of a jumper connection as disclosed in the inventor's co-pending application Ser. No. 14/602,557, filed 22 Jan. 2015, can be used.

However, when assembled as shown in FIG. 6B, the bias of the spring 138 can be sufficient to hold the end connectors 110*a-b* in place on the ends of the shunt tubes 30*a-b*. Although it may not be necessary, features including fasteners, locks, snap collets, snap rings, and the like may be used to lock the tubes 120*a-b* in the extended state and/or lock the end connectors 110*a-b* to the ends of the shunt tubes 30*a-b*. A number of types of such features can be used to keep the tubes 120*a-b* in the extended condition and/or affix the end connectors 110*a-b* to the ends of the shunt tube 30*a-b*, as will be appreciated with the benefit of the present disclosure. Although not preferred, lugs can even be used to lock the tubes 120*a-b* in their extended state. Moreover, a protective shroud or split cover (not shown) can be disposed about the joints between the connected wellscreens 14*a-b* to cover the jumper tube assembly 100 once assembled.

Figure 7A:
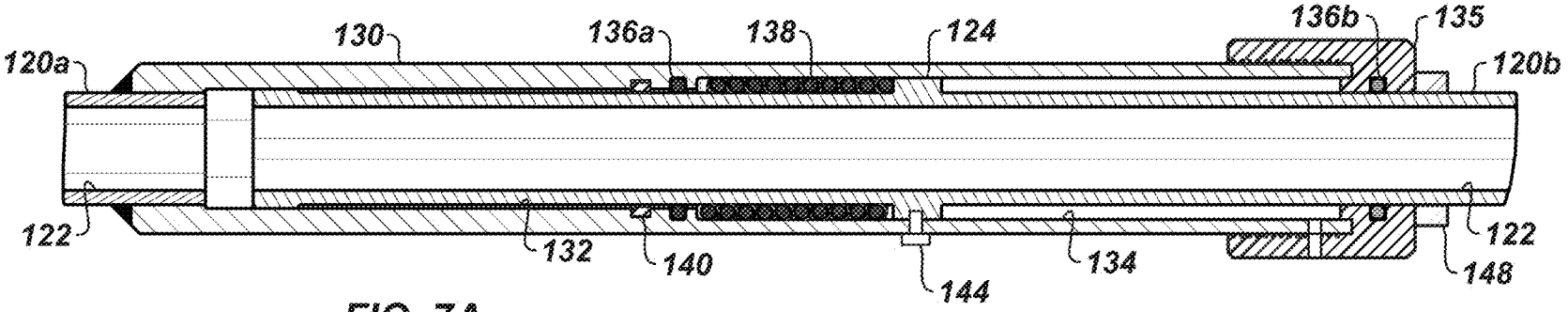
FIGS. 7A-7B illustrate the disclose assembly with various locking features.
Figure 7B:
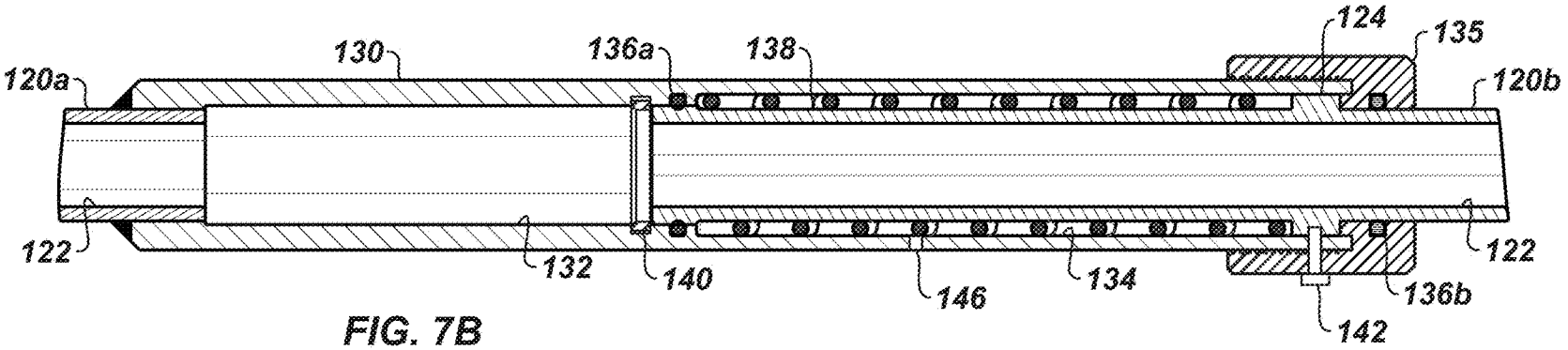

FIGS. 7A-7B show some examples of features to keep the tubes 120*a-b* in the extended condition and optionally to initially hold the tubes 120*a-b* in a retracted condition. One or more of these features may be used on a given installation. In a first example, a recess inside the housing 130 can hold a lock ring 140. Initially as shown in FIG. 7A, the connector tube 120*b* can be inserted and held retracted in the housing 130 (using a feature such as discussed below) so that the lock ring 140 does not lock the tube 120*b*. Then, when the tube 120*b* is extended from the housing 130 by the bias of the spring 138 as shown in FIG. 7B, the lock ring 140 can expand inward to engage a portion of the tube 120*b*, such as a slot or end thereof, to lock the tube 120*b* extended.

In a second example as shown in FIG. 7B, one or more fasteners 142 can affix between the housing 130 and the connector tube 120*b* to lock the tube 120*b* in its extended state. The one or more fasteners 142 can affix in any number of locations other than specifically shown.

As noted above, the connector tube 120*b* can be initially held retracted in the housing 130. This may facilitate assembly steps by operators. In other words, the assembly 100 can be initially in its retracted state for the operator to position between opposing shunt tubes (30*a-b*). Then, the assembly 100 can be extended by releasing an initial lock, fastener, or other feature so that the assembly 100 expands to connect the shunt tube (30*a-b*).

In one example shown in FIG. 7A, one or more fasteners 144 between the housing 130 and the inner connector tube 120*b* can initially hold the assembly 100 in its retracted state. Removal of the one or more fasteners 144 can then allow the bias of the spring 138 to extend the assembly 100 as shown in FIG. 7B. Any resulting opening 146 in the housing 130 can remain sealed by the various seals 136*a-b* on the assembly 100.

In another example shown in FIG. 7A, another type of fastener 148 can be used between the housing 130 and the connector tube 120*b* to initially hold the assembly 100 in its retracted state. This fastener 148 can be a lock ring or the like. Removal of the fastener 148 can then allow the bias of the spring 138 to extend the assembly 100 as shown in FIG. 7B.

As will be appreciated by one skilled in the art, the deployment length for shunt tube assemblies along a wellscreen is a function of the fluid friction loss across the length of deployment. As current completion designs progress, shunt tube installations need to have deployment lengths of at least 4,000 feet and preferably exceeding 5,000 feet. To achieve these lengths, the jumper tube assembly 100 of the present disclosure may need a burst pressure limit exceeding 5,000 psi. and preferably utilizes seals, materials, and the like that provide a high pressure rating.

The foregoing description of preferred and other embodiments is not intended to limit or restrict the scope or applicability of the inventive concepts conceived of by the Applicants. Aside from shunted wellscreens as disclosed herein, the jumper tube assembly of the present disclosure can be used as a quick union with other shunt arrangements, such as those used on packers.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A jumper tube assembly for communicating opposed ends of adjoining tubes on connected wellscreen joints, the assembly comprising:

a first tubular having a first end connectable to one of the opposed ends of the adjoining tubes;

a second tubular having a second end connectable to another of the opposed ends of the adjoining tubes, the second tubular telescopically connected to the first tubular with a third end of the first tubular disposed inside a fourth end of the second tubular; and a biasing element disposed on the third end, the biasing element engaging an external shoulder on the third end and engaging an internal shoulder in the fourth end, the biasing element biasing the first and second tubulars away from one another from a retracted condition toward an extended condition, wherein the first and second tubulars are operable between (i) the retracted condition acting against the bias of the biasing element and retracting the first and second ends from the opposed ends and (ii) the extended condition acting with the bias of the biasing element and extending the first and second ends to the opposed ends of the adjoining tubes.

2. The assembly of claim 1, wherein the first end comprises a first connector connectable to the one opposed end of the adjoining tubes.

3. The assembly of claim 2, wherein the second end comprises a second connector connectable to the other opposed end of the adjoining tubes.

4. The assembly of claim 3, wherein each of the first and second connectors comprises seals engaging the opposed ends of the adjoining tubes when connected thereto.

5. The assembly of claim 2, further comprising a lug removably disposed between the first connector and the opposed end of the adjoining tube and connecting the first connector to the opposed end.

6. The assembly of claim 1, wherein the fourth end of the second tubular comprises a housing member disposed on the second tubular.

7. The assembly of claim 1, comprising at least one seal sealing between the third and fourth ends.

8. The assembly of claim 1, further comprising means for locking the first and second tubulars in the extended condition.

9. The assembly of claim 1, further comprising means for initially holding the first and second tubulars in the retracted condition.

10. The assembly of claim 1, wherein the fourth end of the second tubular comprises a lock ring disposed therein, the third end of the first tubular in the extended condition shouldering against the lock ring.

11. The assembly of claim 1, further comprising at least one fastener removably disposed between the first and second tubulars and affixing the first and second tubulars in the retracted condition.

12. The assembly of claim 1, further comprising at least one fastener removably disposed between the first and second tubulars and affixing the first and second tubulars in the extended condition.

13. The assembly of claim 1, wherein the external shoulder on the third end of the first tubular at a full extent in the extended condition shoulders against an end cap disposed on the fourth end of the second tubular.

14. A wellscreen assembly, comprising:

first and second screen joints connected together and having at least first and second adjoining tubes with opposed ends separated by a gap from one another;

at least one jumper tube having first and second tubulars, the first tubular having a first end connectable to one of the opposed ends of the adjoining tubes, the second tubular having a second end connectable to another of the opposed ends of the adjoining tubes, the second tubular telescopically connected to the first tubular with a third end of the first tubular is disposed inside a fourth end of the second tubular; and a biasing element disposed on the third end, the biasing element engaging an external shoulder on the third end and engaging an internal shoulder in the fourth end, the biasing element biasing the first and second tubulars away from one another from a retracted condition toward an extended condition, wherein the first and second tubulars are operable between (i) the retracted condition acting against the bias of the biasing element and retracting the first and second ends from the opposed ends and (ii) the extended condition acting with the bias of the biasing element and extending the first and second ends to the opposed ends of the adjoining tubes.

15. The assembly of claim 14, wherein the first end comprises a first connector connectable to the one opposed end of the adjoining tubes.

16. The assembly of claim 15, wherein the second end comprises a second connector connectable to the other opposed end of the adjoining tubes.

17. The assembly of claim 16, wherein each of the first and second connectors comprises seals engaging the opposed ends of the adjoining tubes when connected thereto.

18. The assembly of claim 14, wherein the fourth end of the second tubular comprises a housing member disposed on the second tubular.

19. The assembly of claim 14, comprising at least one seal sealing between the third and fourth ends.

20. A method of communicating opposed ends of adjoining tubes on connected wellscreen joints, the method comprising:

retracting first and second tubulars of a jumper tube telescopically together toward a retracted condition by acting against bias of a biasing element between the first and second tubulars;

positioning the retracted jumper tube in a gap between the opposed ends of the adjoining tubes on the connected wellscreen joints;

extending the first and second tubulars to an extended condition by acting with the bias of the biasing element between the first and second tubulars; and engaging first and second ends of the extended first and second tubulars on the opposed ends of the adjoining tubes, wherein retracting against the bias and extending with the bias comprises engaging the biasing element on an external shoulder of one end of the first tubular disposed in another end of the second tubular and engaging the biasing element on an internal shoulder of the other end of the second tubular.

21. The method of claim 20, wherein engaging the first and second ends of the extended first and second tubulars on the opposed ends of the adjoining tubes comprises connecting first and second connectors to the opposed ends of the adjoining tubes.

22. The method of claim 21, wherein connecting the first and second connectors to the opposed ends of the adjoining tubes comprises disposing the first and second connectors on the opposed ends and sealing the first and second connectors therewith.

23. The method of claim 20, further comprising sealing between the ends of the first and second tubulars.

24. The method of claim 20, further comprising locking the first and second tubulars in the extended condition.

25. The method of claim 20, further comprising holding the first and second ends of the extended first and second tubulars with the bias on the opposed ends of the adjoining tubes.

* * * * *